US005936830A

United States Patent [19]

Rousseau et al.

[11] Patent Number: 5,936,830

[45] Date of Patent: Aug. 10, 1999

[54] IGNITION EXCITER FOR A GAS TURBINE ENGINE AND METHOD OF IGNITING A GAS TURBINE ENGINE

[75] Inventors: Francis John Rousseau, Coventry; David Godfrey, Nuneaton; John Louis Bonell, Leicester, all of United Kingdom

[73] Assignee: Lucas Industries Public Limited Co., Solihull, United Kingdom

[21] Appl. No.: 08/854,081

[22] Filed: May 9, 1997

Related U.S. Application Data

[63] Continuation-in-part of application No. 08/787,410, Jan. 22, 1997, abandoned.

[30] Foreign Application Priority Data

Jan. 29, 1996 [GB] United Kingdom ..... 9601731

[51] Int. Cl.[6] ..... H01T 15/00

[52] U.S. Cl. ..... 361/253; 361/257

[58] Field of Search ..... 361/253, 256, 361/257, 263, 247

[56] References Cited

U.S. PATENT DOCUMENTS

| | | | |
|---|---|---|---|
| 2,725,718 | 12/1955 | Sheets et al. | 361/253 |
| 3,260,299 | 7/1966 | Lister | 361/263 |
| 3,949,273 | 4/1976 | Santo | 361/257 |
| 4,001,638 | 1/1977 | Bauer et al. | 361/253 |
| 4,918,569 | 4/1990 | Maeda et al. | 361/263 |
| 5,548,471 | 8/1996 | Roederer | 361/253 |

*Primary Examiner*—Fritz Fleming
*Attorney, Agent, or Firm*—Cantor Colburn LLP

[57] ABSTRACT

An ignition exciter for an engine, comprising a pulse generator for generating output pulses for an igniter plug, and an oscillator for repeatedly triggering the pulse generator at a repetition rate such that each output pulse is produced before ionization caused by a preceding output pulse has substantially disappeared.

15 Claims, 4 Drawing Sheets

IGNITION EXCITER FOR A GAS TURBINE ENGINE AND METHOD OF IGNITING A GAS TURBINE ENGINE

CROSS-REFERENCES TO RELATED APPLICATIONS

This application is a continuation-in-part of U.S. patent application Ser. No. 08/787,410 filed Jan. 22, 1997, now abandoned.

BACKGROUND OF THE INVENTION

The present invention relates to an ignition exciter, particularly but not exclusively, for a gas turbine engine and to a method of igniting an engine, particularly but not exclusively, a gas turbine engine, for instance for aerospace applications.

A known ignition exciter for an engine supplies high voltage pulses to an igniter plug located in a combustion chamber of the engine. In general, the ignition exciter is operated during starting of the engine and, once combustion has been successfully established, the ignition exciter is switched off. However, in some applications where it is essential to maintain combustion continuously, the ignition exciter may run continuously. Ignition exciters of this type supply pulses to the igniter plug at a repetition rate which is typically between 0.5 and 5 hertz.

SUMMARY OF THE INVENTION

According to a first aspect of the invention, there is provided an ignition exciter for an engine, comprising a pulse generator for generating output pulses for an igniter plug, and an oscillator for repeatedly triggering the pulse generator at a repetition rate such that each output pulse is produced before ionisation caused by a preceding output pulse has substantially disappeared.

The repetition rate may be from substantially 400 hertz up to about 10 kilohertz and a preferred repetition rate is 4 kilohertz.

The pulse generator may comprise a step-up transformer and a current switch for switching current through a primary winding of the step-up transformer, for instance in the form of a flyback converter. An inductor may be connected in series with the step-up transformer and the current switch. A reservoir capacitor may be connected across the step-up transformer, the current switch and the inductor, the inductor comprising a primary winding of a further transformer having a secondary winding connected via at least one diode with a first conduction direction across the reservoir capacitor. The further transformer may comprise a further secondary winding connected via at least one further diode having a second conduction direction opposite the first conduction direction across the reservoir capacitor. The current switch may be a semiconductor switch, such as an insulated gate bipolar transistor. A secondary winding of the step-up transformer may be connected to an output circuit of the exciter comprising a first series capacitor and a second parallel capacitor.

The pulse generator may comprise a controller, such as a pulse width modulator, for opening the current switch when current through the primary winding has risen to a predetermined value, thereby controlling the energy stored in the step-up transformer.

According to a second aspect of the invention, there is provided a method of igniting an engine, comprising generating a series of sparks in a combustion chamber of the engine having a repetition rate such that each spark is produced before ionisation caused by a preceding spark has substantially disappeared.

It is thus possible to supply energy continuously so as to excite fuel molecules and initiate combustion. The level of excitement of each molecule is effectively built upon so that the degree of excitation is cumulative. Improved reliability of ignition is therefore achieved so that a gas turbine engine can be started or re-started quickly and reliably.

BRIEF DESCRIPTION OF THE DRAWINGS

The invention will be further described, by way of example, with reference to the accompanying drawings, in which.

Like reference numerals refer to like parts throughout the drawings.

DESCRIPTION OF THE PREFERRED EMBODIMENTS

Figure 1:
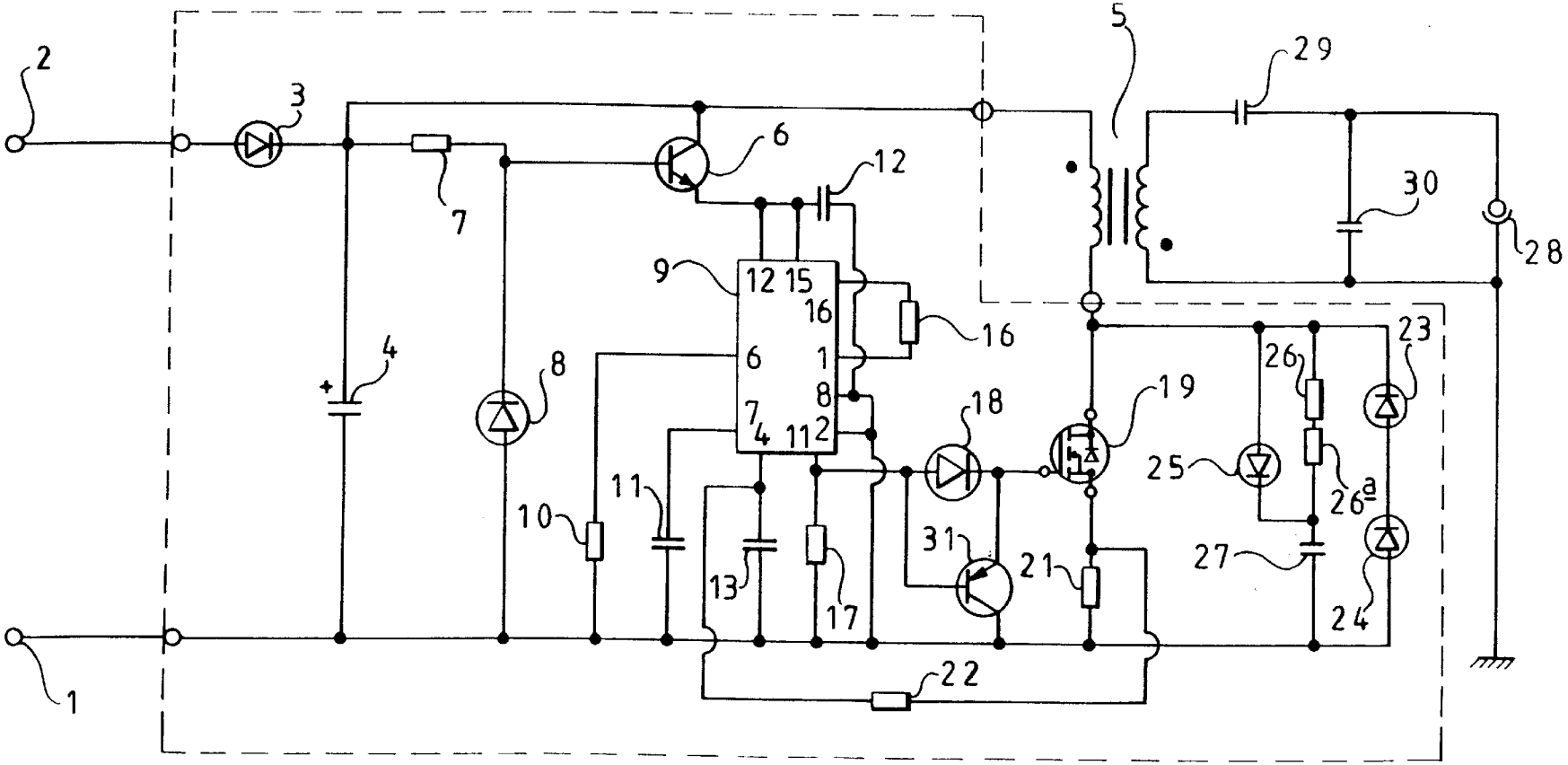
FIG. 1 is a circuit diagram of an ignition exciter for a gas turbine engine constituting an embodiment of the present invention.

The exciter has a common supply terminal 1 and a supply terminal 2 for receiving a supply voltage, for instance 28 volts. The terminal 2 is connected to the anode of a diode 3 whose cathode is connected to a first terminal of a reservoir and supply decoupling capacitor 4 having a second terminal connected to the common terminal 1. The cathode of the diode 3 is connected to a first terminal of a primary winding of a pulse step-up transformer 5 and to the collector of a transistor 6. The cathode of the diode 3 is connected to a first terminal of a resistor 7 whose second terminal is connected to the base of the transistor 6 and via a zener diode 8 to the common terminal 1. The emitter of the transistor 6 is connected to supply inputs of an integrated circuit 9 and, together with the resistor 7 and the zener diode 8, provides a stabilised low voltage supply to the integrated circuit 9.

The integrated circuit 9 is a pulse width modulation controller of type number SG1524B supplied by Silicon General. The numerals within the block representing the integrated circuit 9 indicate the pin numbers of the integrated circuit. The integrated circuit 9 comprises a free-running oscillator whose repetition rate is set by a resistor 10 and a capacitor 11 to 4 kilohertz although the useful range of repetition rate is from about 400 hertz to about 10 kilohertz. The integrated circuit 9 is provided with decoupling capacitors 12 and 13. A resistor 16 connects an unused input of the integrated circuit 9 to an internal reference voltage.

The integrated circuit 9 has an output connected via a load resistor 17 to the common terminal 1 and via a diode 18 to the gate of an insulated gate bipolar transistor (IGBT) 19. The collector of the transistor 19 is connected to a second terminal of the primary winding of the transformer 5. The emitter of the transistor 19 is connected via a low value current sensing resistor 21 to the common terminal 1 and via a resistor 22 to a sensing input of the integrated circuit 9. A transistor 31 has its base and emitter connected to the anode and cathode, respectively, of the diode 18 and its collector connected to the terminal 1. The second terminal of the primary winding of the transformer 5 is connected to the common terminal 1 via a network comprising zener diodes 23 and 24, a diode 25, resistors 26, 26*a*, and a capacitor 27. The circuit therefore functions as a flyback convertor producing high voltages pulses across the secondary winding of the transformer 5.

The secondary winding is connected to an output 28 of the exciter via a capacitor 29. A capacitor 30 is connected across the output terminals 28. The value of the capacitor 29 may be adjusted so as to adjust the duration of the spark at an igniter plug connected to the output 28. The capacitor 30 stores charge until the igniter plug breaks down and then provides an initial relatively high rate of change of current through the igniter plug by discharging a small amount of energy, after which the spark is maintained by discharge of the energy stored in the transformer 5.

Although the exciter shown in FIG. 1 is intended to be connected to a relatively low voltage (e.g. 28 volts) power supply, it may be modified as described hereinafter for use with a relatively high voltage power supply, for instance supplying 270 volts. In such a case, power for the integrated circuit may be supplied from a third winding on the transformer 5 via rectifying and smoothing circuitry as appropriate.

In use, the supply terminals 1 and 2 are connected to a suitable power supply throughout operation of the gas turbine engine so that the ignition exciter causes the spark plug to be able to produce sparks continuously. For as long as power is supplied to the ignition exciter, the oscillator within the integrated circuit 9 oscillates at a repetition rate of about 4 kilohertz. During each period of oscillation, the transistor 19 is initially switched on so as to connect the primary winding of the transformer 5 in series with the current sensing resistor 21 across the supply terminals 1 and 2. The voltage developed across the current-sensing resistor 21 is monitored by the integrated circuit 9 until it rises to a predetermined value, at which time the transistor 19 is switched off by means of the transistor 31. The transistor 31 is caused to conduct so as to discharge the gate of the transistor 19 rapidly to the common terminal 1, thus ensuring rapid switch-off of the transistor 19. The detailed operation of flyback convertors is well known and will not be described further.

A high voltage pulse having a maximum value greater than or equal to 6 kilovolts is produced across the secondary winding of the transformer 5 and charges up the capacitor 30. When the voltage across the capacitor 30 is sufficient to break down the igniter plug and cause ionisation of the air/fuel mixture within a combustion chamber of the gas turbine engine, the voltage across the output 28 and hence across the igniter plug falls to a lower "maintaining" value which maintains the spark generated by the igniter plug. The circuit is designed to be able to generate a pulse of about 10 kilovolts but under normal operating conditions a pulse of 6 kilovolts is sufficient to break down the igniter plug. Thereafter the peak voltage of subsequent pulses is about 1 kilovolt provided that engine ignition is maintained. The minimum pulse voltage to maintain ionisation is about 200 to about 300 volts which is much higher than the typical maintaining voltage of 30 volts supplied by known exciters of the capacitor-discharge type. The secondary winding of the transformer 5 and the capacitors 29 and 30 cooperate with the igniter plug such that the plug operates with high maintaining voltage and low maintaining current.

Figure 2:
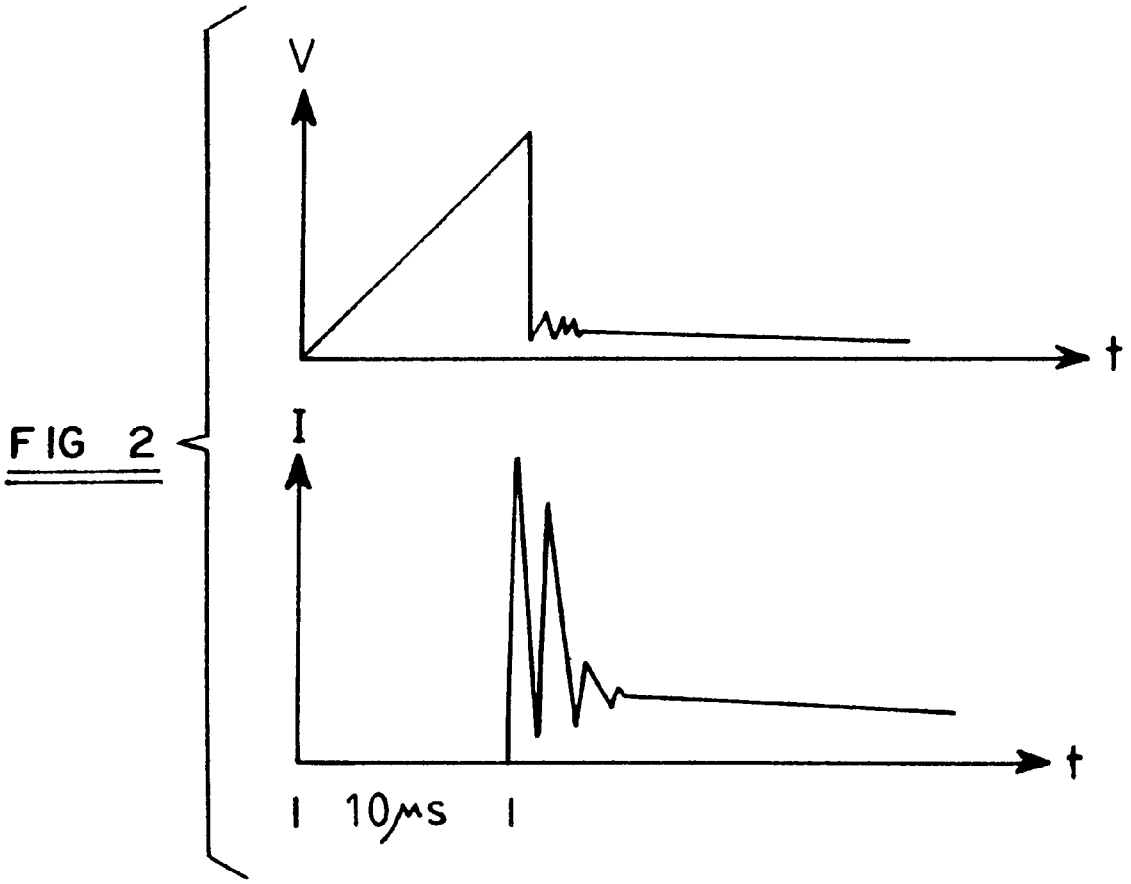
FIG. 2 illustrates output waveforms of the exciter shown in FIG. 1 in the form of graphs of voltage V and current I against a common time axis t.

The waveforms shown in FIG. 2 relate to the first few microseconds after the transistor 19 has switched off. The output voltage waveform is shown in the upper graph of FIG. 2 for a single pulse produced by the exciter shown in FIG. 1. Before the igniter plug has not yet fired the voltage across it ramps up linearly and the current from the secondary winding of the transformer charges the capacitor 30. The voltage at which the plug fires is dependent upon a number of factors including engine condition, engine temperature and the presence of ionised gas from a previous firing. As mentioned above, the breakdown voltage can be less than 1 kilovolt or as high as 10 kilovolts.

At plug breakdown, the current discharge from the capacitor 30 rapidly ionises the gases/vapour around the plug so that the spark across the plug can be maintained at relatively low current. The rapid increase in output current is illustrated in the lower graph of FIG. 2. As the capacitor 30 discharges, the output current falls to a lower value sufficient to maintain the spark for a longer period. The width of the initial large current pulse may be adjusted by adjusting the value of the capacitor 30. Once the plug has broken down, a resonant circuit exists between the inductance of the transformer secondary winding and the capacitor 29. As a result of the voltage across the plug falling to a low level, not all of the stored energy of the transformer is dissipated in the positive part of the cycle. The "surplus" is stored in the capacitor 29 to be discharged through the plug in the negative part of the cycle, thus effecting a considerable increase in the power of the spark.

The repetition rate of the oscillator within the integrated circuit 9, and hence of the output pulses produced by the ignition exciter, is sufficiently high for each output pulse to be produced before ionisation produced by a preceding output pulse has declined to a relatively low value. The effect of this is that each pulse tends to add cumulatively to ionisation of the air/fuel mixture in the combustion chamber so as to improve the speed and reliability of ignition of the gas turbine engine. Ionisation declines or "relaxes" over a period which is typically of the order of milliseconds. The electrical sparks produced at the igniter plug are shorter than this but the repetition rate is such that ionisation does not relax to an undesirable degree between exciter output pulses but increases until ignition occurs.

Apart from controlling the voltage across the plug and the peak current through the plug, the output circuit comprising the capacitors 29 and 30 prevents a short circuit in an igniter plug or plug lead connecting it to the output 28 from imposing a short circuit onto the input of the exciter which would otherwise draw an undesirably high current from the supply. The use of a separate oscillator, rather than a self-oscillating convertor, ensures that the repetition rate of the output pulses is substantially unaffected by load impedance at the output 28. For instance, a fouled igniter plug has substantially no effect on the pulse repetition rate of the exciter.

The relatively high repetition rate allows the use of a more compact transformer 5 so that the weight of the exciter may be reduced.

The exciter provides a substantially continuous arc. Thus, plug wear is relatively low because it is not subject to "shock pulses". The exciter may be used with both semiconductor and air gap igniter plugs.

The power consumption of the exciter is not substantially different from conventional exciters operating at much lower repetition rates as described hereinbefore. Although the energy of each spark produced by the exciter shown in FIG. 1 is much less than the energy of each spark for a conventional exciter, the cumulative ionisation effect resulting in a substantially continuous arc provides improved reliability.

In the exciter shown in FIG. 1, the transformer 5 typically has a step-up ratio of 20:1. Thus, any voltage "reflected" back into the primary winding of the transformer 5 will be less than 500 volts. This limit is of practical importance because it is the limit of economically available switching transistors for embodying the transistor 19. Also, during the "forward mode" of the converter when the transistor 19 is conducting, the voltage generated across the secondary winding of the transformer 5, which is a maximum of the product of the turns ratio and the supply voltage e.g. about 560 volts, is insufficient to breakdown the igniter plug connected to the output terminals 28. In general, a voltage of less than 1 kilovolt should not cause undesired breaking down of the igniter plug. If the igniter plug were to breakdown during conduction of the transistor 19, it would present a relatively low impedance which would be reflected into the primary winding of the transformer 5. This would lead to an exceedingly high input current, for instance greater than 50 amps, to flow, which is unacceptable.

Although the exciter shown in FIG. 1 could be used with high supply voltages, such as 270 volts, this leads to difficulties. For instance, the high turns ratio, such as 20:1, of the transformer 5 is required in order to reduce voltages reflected back into the primary winding. However, in order to reduce the voltage appearing across the secondary winding during the forward mode of the converter, a relatively low turns ratio, such as 3:1, would be required so as to prevent undesirable breaking down of the igniter plug.

Figure 3:
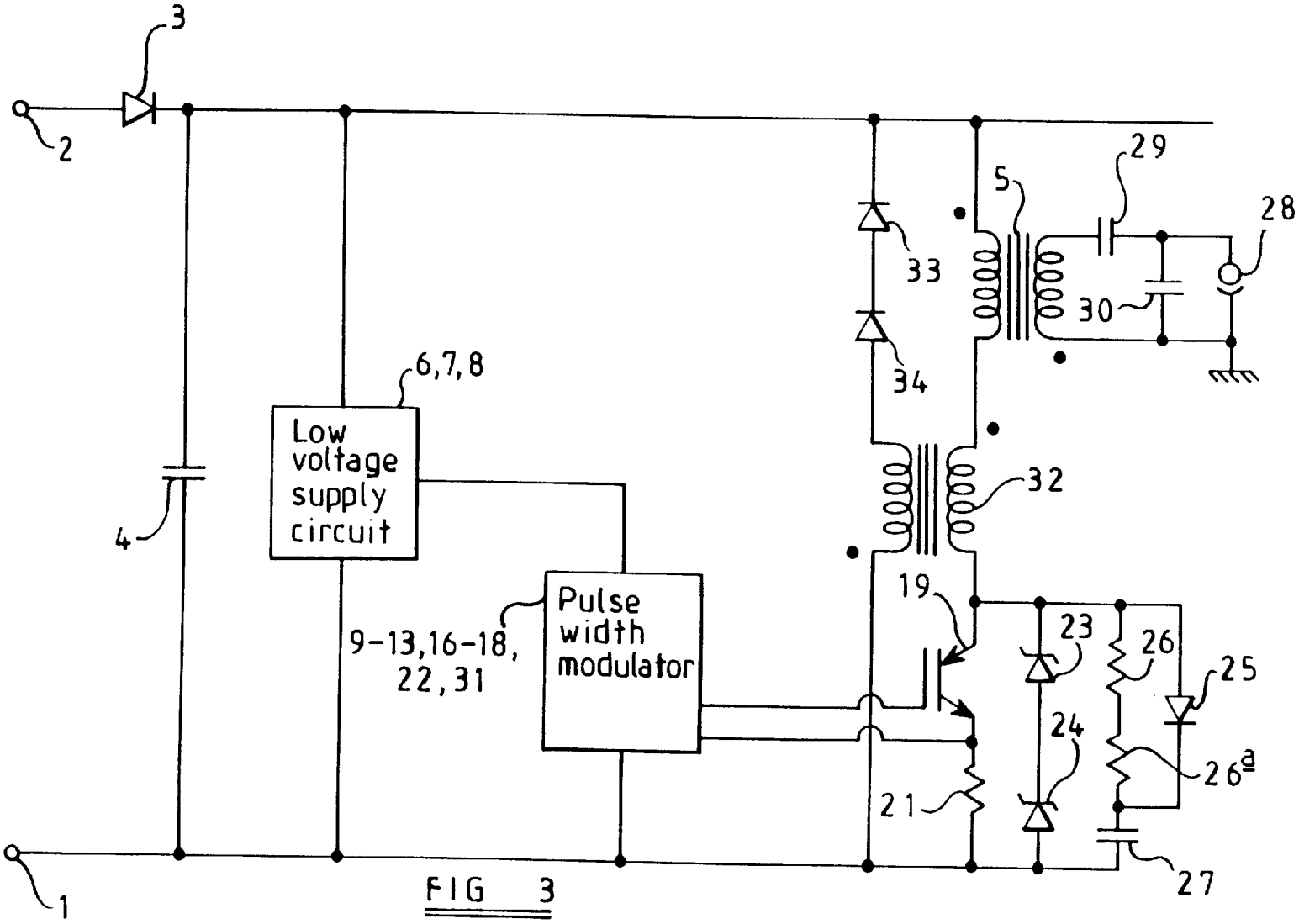
FIG. 3 is a circuit diagram of an exciter constituting a second embodiment of the invention.

In order to avoid these conflicting requirements, the circuit shown in FIG. 1 may be modified as shown in FIG. 3 for use with high supply voltages, such as 270 volts. A low voltage supply circuit, shown as comprising the components 6, 7 and 8 of FIG. 1, is again required to supply a stable low supply voltage to the integrated circuit 9 which, together with the components 10 to 13, 16 to 18, 22 and 31, forms the pulse width modulator. The transformer 5 in the embodiment of FIG. 3 has a relatively high turns ratio, for instance 20:1. The components 19, 21, 23 to 27 and 28 to 30 are as described with reference to FIG. 1.

In order to provide the circuit shown in FIG. 3, the circuit of FIG. 1 is modified by the inclusion of an inductor connected between the collector of the transistor 19 and the primary winding of the transformer 5. In this embodiment, the inductor comprises the primary winding of a transformer 32 whose secondary winding is connected via diodes 33 and 34 across the reservoir and decoupling capacitor 4.

Although the transformer 32 could be replaced by a single winding inductor connected between the transistor 19 and the primary winding of the transformer 5. It would be necessary to connect a resistor in parallel with the inductor so as to dissipate energy stored in the inductor. The self-inductances of the inductor and the primary winding of the transformer 5 are chosen so that the voltage appearing across the primary winding of the transformer 5 is not sufficient to cause the igniter plug to breakdown while the transistor 19 is conducting. However, in practice, such an inductor would store more energy than the transformer 5, which would substantially reduce the electrical efficiency of the exciter.

By using the transformer 32 as the inductor, the energy stored in the transformer 32 can be recycled. In particular, when the transistor 19 turns off, the energy stored in the transformer 5 is transferred to the igniter plug as described hereinbefore whereas the energy stored in the transformer 32 is returned to the capacitor 4 so as to be available for the next cycle of operation when the transistor 19 conducts.

The turns ratios of the transformers 5 and 32 are chosen such that the peak voltage generated across the collector of the transistor 19 does not exceed the safe working voltage when the transistor switches off.

With the arrangement shown in FIG. 3, the transformer 32 is working in the fly-back mode so that stored energy is returned to the capacitor 4 when the transistor 19 switches off. Alternatively, the connections to one of the windings of the transformer 32 may be reversed so that it operates in the forward mode and returns energy to the power supply when the transistor 19 is conducting, as in the arrangement shown in FIG. 4.

Figure 4:
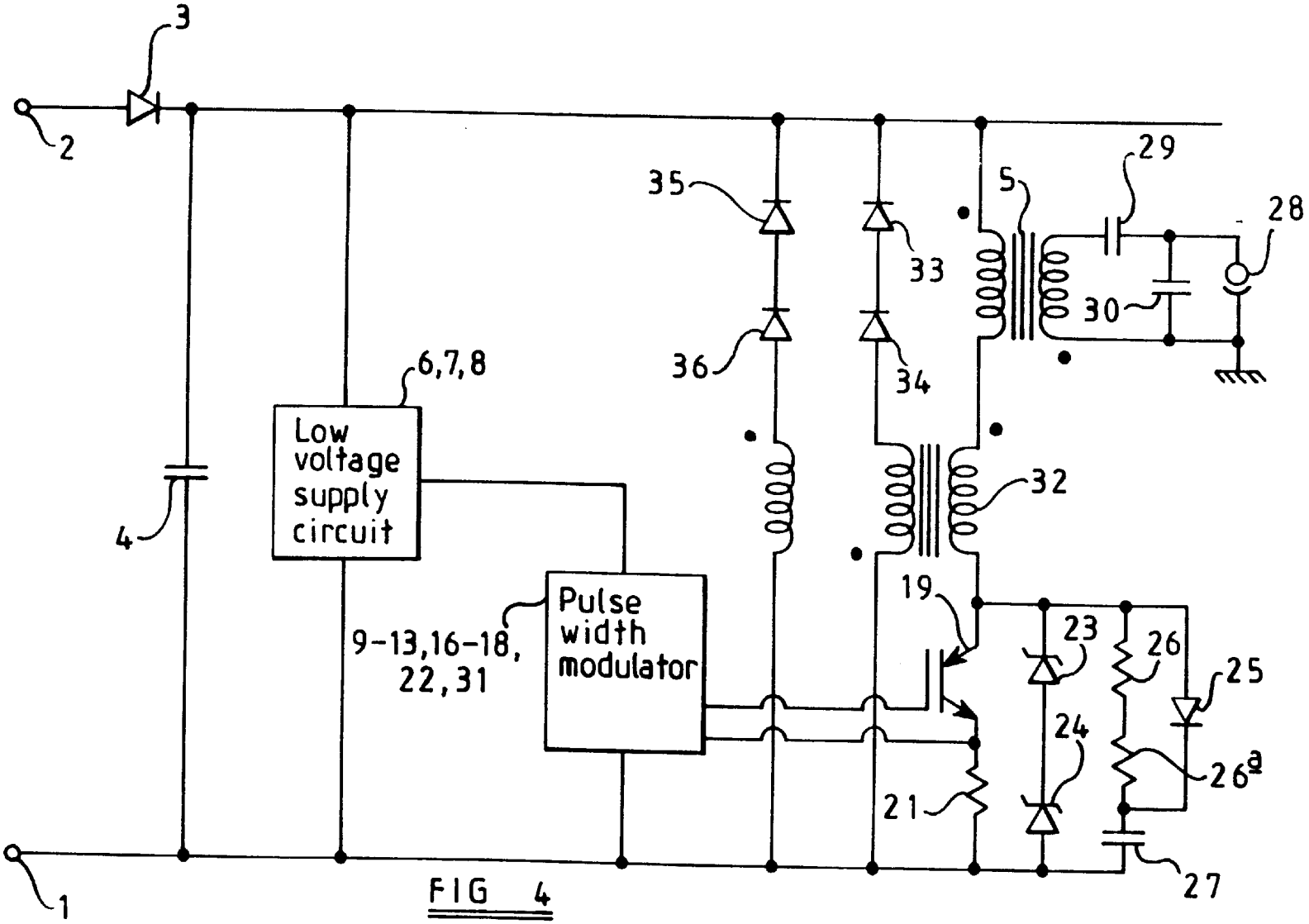
FIG. 4 is a circuit diagram of an exciter constituting a third embodiment of the invention.

The exciter shown in FIG. 4 differs from that shown in FIG. 3 in that energy from the transformer 32 is returned in both the forward and the fly-back modes. The transformer 32 has another secondary winding which is connected via diodes 35 and 36 across the capacitor 4. During the fly-back mode, when the transistor 19 is switched off, the magnetising energy in the transformer 32 is returned to the capacitor 4 via the diodes 33 and 34.

During the forward mode, when the transistor is switched on, excess energy passes through the transformer 32 and is returned to the capacitor 4 via the diodes 35 and 36. This substantially reduces the current from the power supply connected to the terminals 1 and 2. It is possible to reduce the current from the supply to 25% or less compared with merely dissipating the excess energy as heat.

We claim:

1. An ignition exciter for an engine, comprising:

a pulse generator for generating output pulses for an igniter plug, said pulse generator comprises a flyback converter including a step-up transformer and a current switch for switching current through a primary winding of the transformer;

an oscillator for repeatedly triggering the pulse generator at a repetition rate such that each output pulse is produced before ionisation caused by a preceding output pulse has substantially disappeared;

an inductor connected in series with said step-up transformer and said current switch; and a reservoir capacitor connected across said step-up transformer, said current switch and said inductor, said inductor comprising a primary winding of a further transformer having a secondary winding connected via at least one diode with a first conduction direction across said reservoir capacitor.

2. An ignition exciter as claimed in claim 1, arranged to produce a repetition rate in the range 400 hertz to 10 kilohertz.

3. An ignition exciter as claimed in claim 2, arranged to produce a repetition rate of the order of 4 kilohertz.

4. An ignition exciter as claimed in claim 1, wherein said current switch is an insulated gate bipolar transistor.

5. An ignition exciter as claimed in claim 1, wherein a secondary winding of the step-up transformer is connected to an output circuit of the exciter including a first series capacitor and a second parallel capacitor.

6. An ignition exciter as claimed in claim 1 in which said further transformer comprises a further secondary winding connected via at least one further diode having a second conduction direction opposite said first conduction direction across said reservoir capacitor.

7. An ignition exciter for an engine, comprising:

a pulse generator for generating output pulses for an igniter plug, said pulse generator including a step-up transformer and a current switch for switching current through a primary winding of the transformer;

an oscillator for repeatedly triggering the pulse generator at a repetition rate such that each output pulse is produced before ionisation caused by a preceding output pulse has substantially disappeared; and a pulse width modulator for operating the current switch when the current flowing in the primary winding of the step-up transformer has risen to a predetermined value, thereby controlling the energy stored in said transformer.

8. An ignition exciter as claimed in claim 1, wherein said pulse generator comprises a flyback converter.

9. An ignition exciter as claimed in claim 8, comprising an inductor connected in series with said step-up transformer and said current switch.

10. An ignition exciter as claimed in claim 9, comprising a reservoir capacitor connected across said step-up transformer, said current switch and said inductor, said inductor comprising a primary winding of a further transformer having a secondary winding connected via at least one diode with a first conduction direction across said reservoir capacitor.

11. An ignition exciter as claimed in claim 10, in which said further transformer comprises a further secondary winding connected via at least one further diode having a second conduction direction opposite said first conduction direction across said reservoir capacitor.

12. An ignition exciter as claimed in claim 7, comprising a resistor in series with said current switch for sensing the current flowing in said primary winding.

13. An ignition exciter as claimed in claim 7 wherein said current switch is an insulated gate bipolar transistor.

14. An ignition exciter as claimed in claim 7 wherein a secondary winding of the step-up transformer is connected to an output circuit of the exciter including a first series capacitor and a second parallel capacitor.

15. An ignition exciter for an engine, comprising:

a pulse generator for generating output pulses for an igniter plug, said pulse generator including a step-up transformer and a current switch for switching current through a primary winding of the transformer; and a secondary winding of the step-up transformer connected to an output circuit of the exciter including a parallel capacitor for establishing an initial current to the igniter plug and a series capacitor for establishing spark duration and;

an oscillator for repeatedly triggering the pulse generator at a repetition rate such that each output pulse is produced before ionisation caused by a preceding output pulse has substantially disappeared.

* * * * *